United States Patent [19]

Lirette

[11] Patent Number: 4,829,910

[45] Date of Patent: May 16, 1989

[54] FOLDING TABLE FOR A RECREATIONAL VEHICLE

[76] Inventor: Edward F. Lirette, 1527 Warwick Ct., Ann Arbor, Mich. 48103

[21] Appl. No.: 9,462

[22] Filed: Feb. 2, 1987

[51] Int. Cl.[4] ..... A47B 1/04

[52] U.S. Cl. ..... 108/80; 108/35

[58] Field of Search ..... 108/80, 40, 48, 33, 108/35, 37, 38, 123, 120, 41; 248/290.1, 290.2; 292/278, 262, 338, 339; 312/313, 314, 317 R

[56] References Cited

U.S. PATENT DOCUMENTS

| | | | |
|---|---|---|---|
| 1,272,983 | 7/1918 | Menzo | 312/317 X |
| 1,511,925 | 10/1924 | Wasmuth . | |
| 1,699,496 | 1/1929 | Wasmuth | 108/40 |
| 1,759,800 | 5/1930 | Noack . | |
| 1,775,307 | 9/1930 | Gennar . | |
| 1,796,002 | 3/1931 | Covell | 108/37 |
| 1,953,038 | 3/1934 | Bessler . | |
| 1,998,483 | 4/1935 | Bailey | 108/123 |
| 2,015,237 | 9/1935 | Sadenwater | 108/123 |
| 2,619,395 | 11/1952 | Kent | 108/38 |
| 2,643,420 | 6/1953 | Schwartz | 292/278 X |
| 2,876,028 | 3/1959 | Shoup . | |
| 2,996,210 | 8/1961 | Thomas | 292/278 X |
| 3,062,544 | 11/1962 | Viets | 108/40 X |
| 3,242,882 | 3/1966 | Hoyt | 108/48 |
| 4,263,854 | 4/1981 | Moore et al. | 108/40 X |
| 4,501,457 | 2/1985 | Pond . | |

*Primary Examiner*—Kenneth J. Dorner
*Assistant Examiner*—José V. Chen
*Attorney, Agent, or Firm*—James M. Deimen

[57] ABSTRACT

A folding table comprising a hollow vertical cabinet and a two section table extending to one side wherein the outboard section is substantially smaller than the inboard section. The inboard section slides vertically into a vertical cabinet, with the cabinet top open. Upon insertion of the inboard section, the outboard section forms a side table. A telescoping support, extending from the outboard section to the bottom of the vertical cabinet, provides necessary support to the extended table and includes a gravity actuated hidden latch within the support cover. The latch engages and releases depending on the angular position of the support and includes means to prevent unlatching from inadvertent vibration or jarring of the table.

16 Claims, 4 Drawing Sheets

10
12
14
16
18
20
22
24
26
28
30
38
40
48
50
52
54
56
58
62

FOLDING TABLE FOR A RECREATIONAL VEHICLE

BACKGROUND OF THE INVENTION

The field of the invention pertains to furniture that may be folded into a storage cabinet and unfolded for use. In particular, the invention pertains to tables that may be unfolded into a level position for use and refolded into a vertical storage cabinet during non-use.

U.S. Pat. No. 1,511,925 discloses a table that folds into a vertical cabinet. The table is supported by a separate leg at the extreme end which also folds to fit inside the cabinet. The front of the cabinet opens partially to permit storage of the folded table and folded leg within the cabinet. The terminating end of the table attached to the leg must be turned upside down atop the balance of the table and the leg folded before the table can be stored within the cabinet.

U.S. Pat. No. 1,759,800 discloses a solid piece table top which folds down from a built in wall storage unit. Separate benches for either side of the table fold down from the inside of the covered doors of the storage cabinet. Fold down legs support the benches. However, no fold down leg is disclosed for the table, thus limiting the practical length for the table.

In a similar manner, U.S. Pat. No. 1,775,307 discloses a table which folds down from a built in wall cabinet and includes a supporting leg at the extended end of the table. A bench with supporting legs folds down from one of the covered doors of the storage cabinet. A longitudinal hinge attaches a second folding portion of the table to the first portion of the table.

U.S. Pat. No. 1,953,038 discloses a number of furnishings that may be folded and unfolded from a built in storage cabinet. The disclosure includes a folding table with a leg at the extended end, a staircase to an upper floor, a bed, and an ironing board, all of which are provided with complicated mechanisms for folding and unfolding from the storage cabinet.

U.S. Pat. No. 4,501,457 discloses a kitchen table with drawers which fold from a cabinet affixed to the outside of a motor vehicle camper. The cabinet is also designed to include cooking utensils and includes an extensible leg to support the table in a horizontal position.

U.S. Pat. No. 2,876,028 discloses an adjustable strap having a spring actuated pin which drops through a selective hole in the strap and an alignment hole.

With a view toward providing a more compact and more easily operable folding table without a leg at the extended end, applicant has invented the table disclosed below.

SUMMARY OF THE INVENTION

The new table comprises a vertical enclosed cabinet topped by a hinged cover and a two section table top hinged together. The outboard section is substantially smaller than the inboard section, and supported by an enclosed telescopic support. The telescopic support is pinned adjacent the bottom of the vertical cabinet and includes a gravity actuated latch that falls into place when the table is fully extended. Thus, no table legs interfere with seated persons or persons walking by the table.

The table is folded into the vertical cabinet by lifting the top and rotating and sliding the larger portion of the table top down into the cabinet. When fully collapsed, the smaller outboard section of the table becomes a short table extending from the cabinet. Within the cabinet is a roller and slide mechanism to guide the larger section of the table into and out of the cabinet. The cabinet is intended to be attached to the inside wall of a recreational vehicle or motor home and located between two comfortable chairs or benches. Unfolded, the table serves as a dining or card table for four persons. Folded, the small outboard end of the table serves as a convenient small side table for an ashtray and other odds and ends. The table is preferably manufactured substantially of wood and in the preferred embodiment disclosed below takes one person less than five seconds to extend or retract the table.

DESCRIPTION OF THE PREFERRED EMBODIMENT

Figures 1, 6:
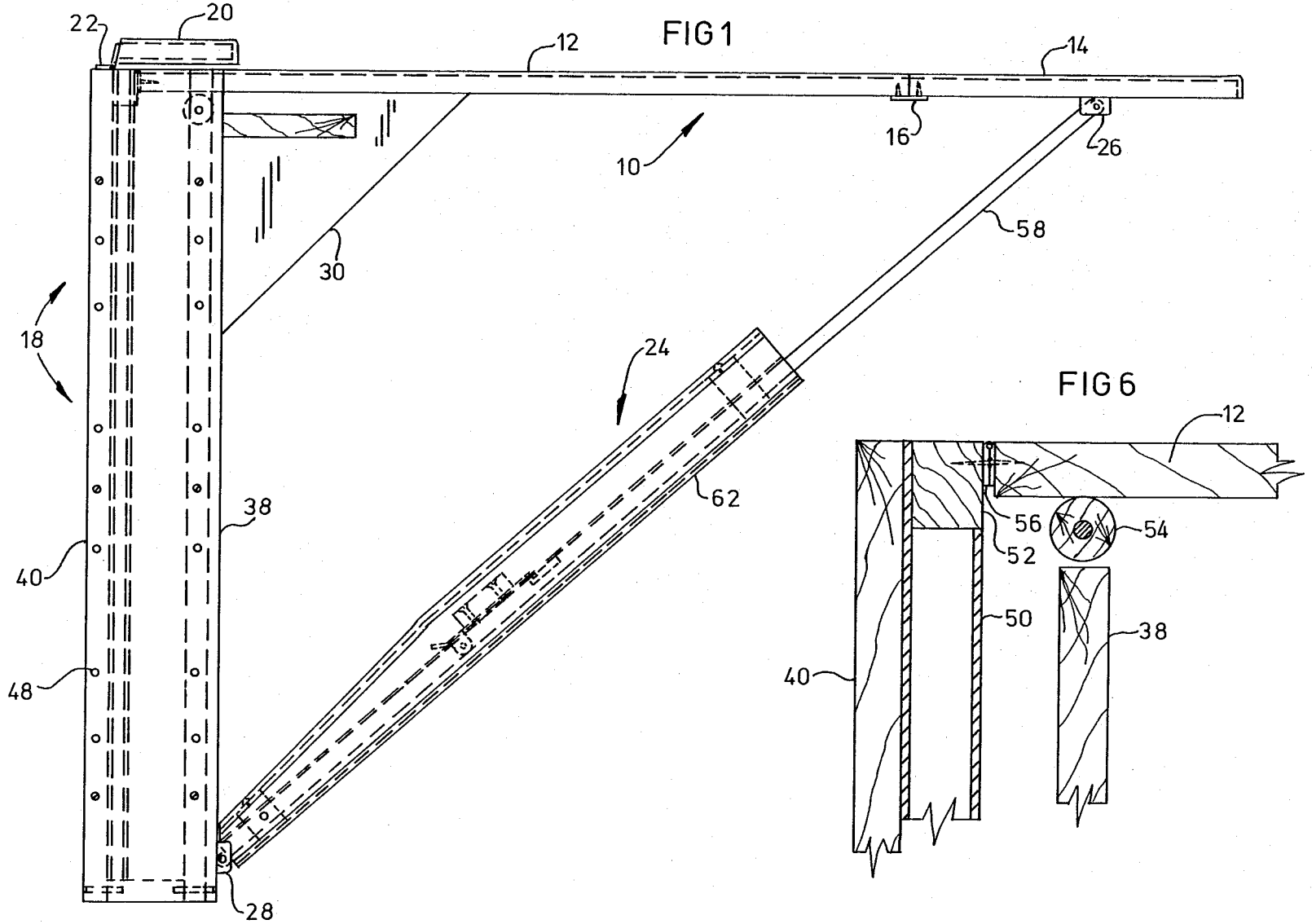
FIG. 1 is a side view of the table in the unfolded position.
FIG. 6 is a section taken along the line BB in FIG. 2.
Figure 2:
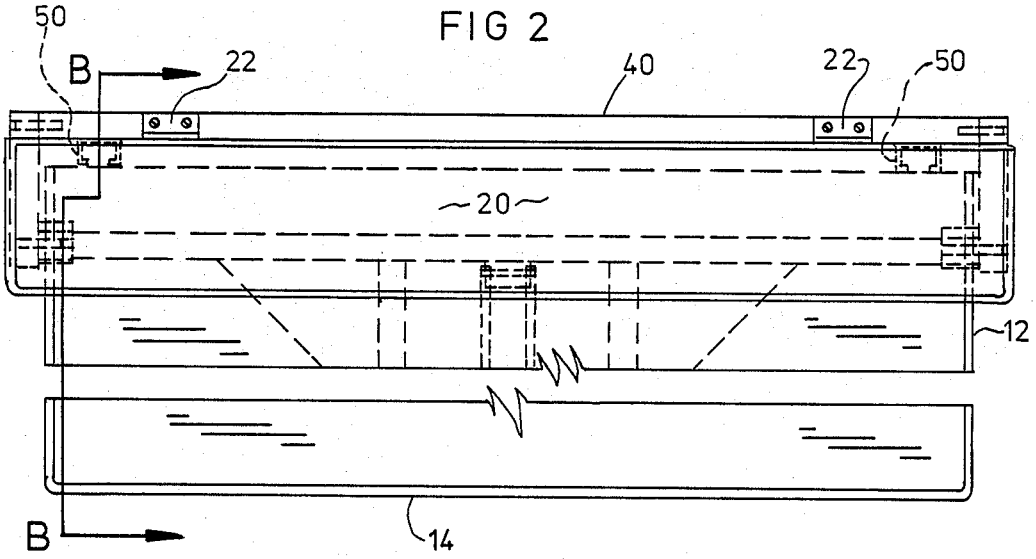
FIG. 2 is a partially cut-away top view of the table.
Figure 3:
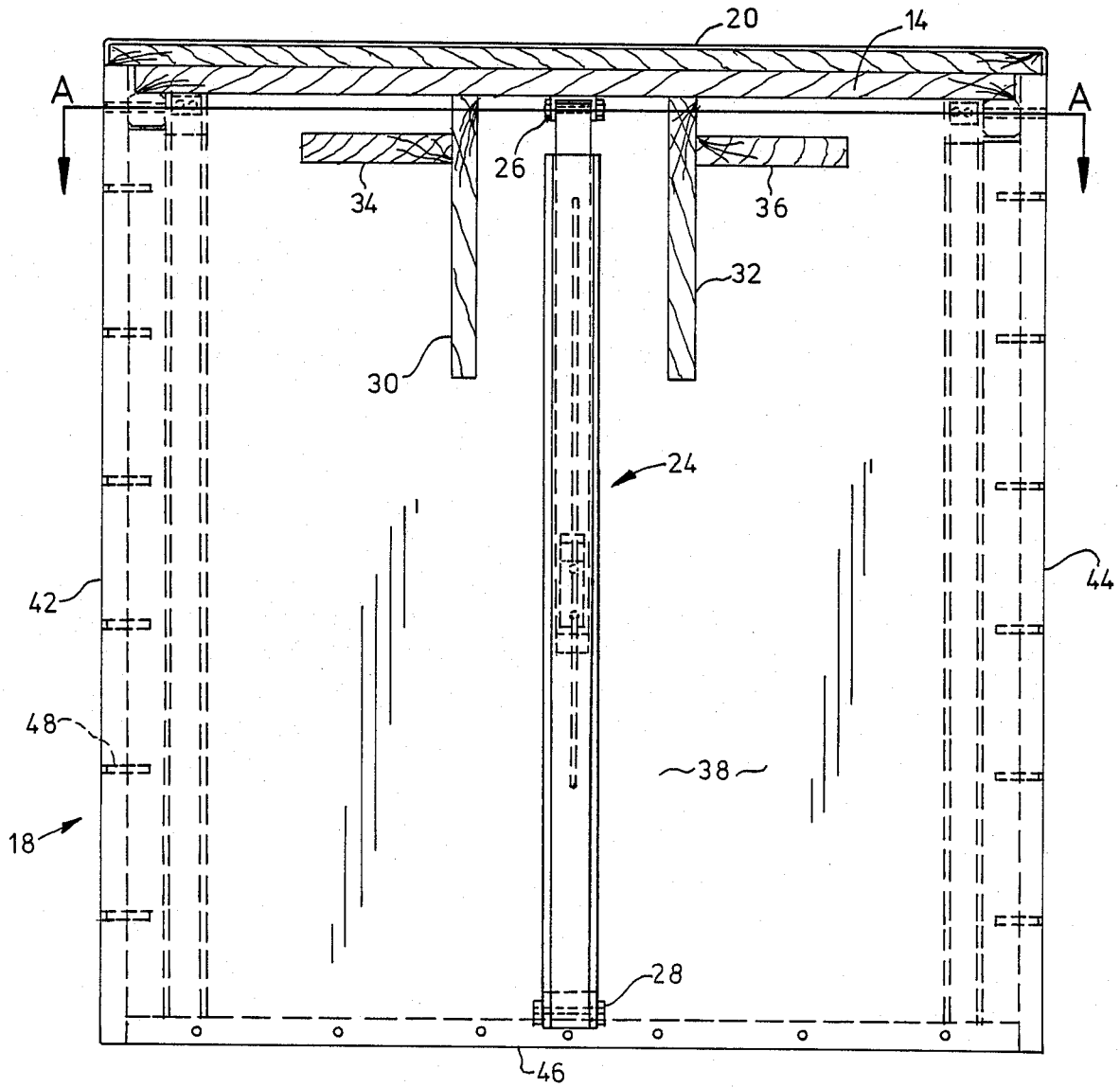
FIG. 3 is a front view of the table.

In FIGS. 1, 2 and 3 the table, generally denoted by 10, comprises a larger inboard section 12 and smaller outboard section 14, joined by a transverse hinge 16 affixed to the lower surfaces of the sections 12 and 14. A hollow enclosure or cabinet, generally denoted by 18, supports the inboard end of the table 10 and has a cover 20 fastened to the cabinet by transverse hinges 22. The hinges 16 and 22 may be piano hinges or two or more separate hinges may be utilized.

The outboard section 14 of the table is supported by diagonal telescoping support means generally denoted by 24 and attached to the outboard section 14 and cabinet 18 with pin fastening means at 26 and 28, respectively. Fastened to the cabinet are a pair of triangular gussets 30 and 32, in turn braced against lateral movement by secondary triangular gussets 34 and 36. The gussets 30 and 32 support the inboard end of the table section 12 when fully extended and as further explained below, the outboard section 14 when the table 10 is in the folded position.

The cabinet comprises a hollow structure having a front 38, back 40, ends 42 and 44 and bottom 46, all permanently fastened together with dowels as generally indicated at 48. Only the top 20 of the cabinet opens to permit the larger inboard section 12 of the table to slide through the aperture and fit inside.

Figure 5:
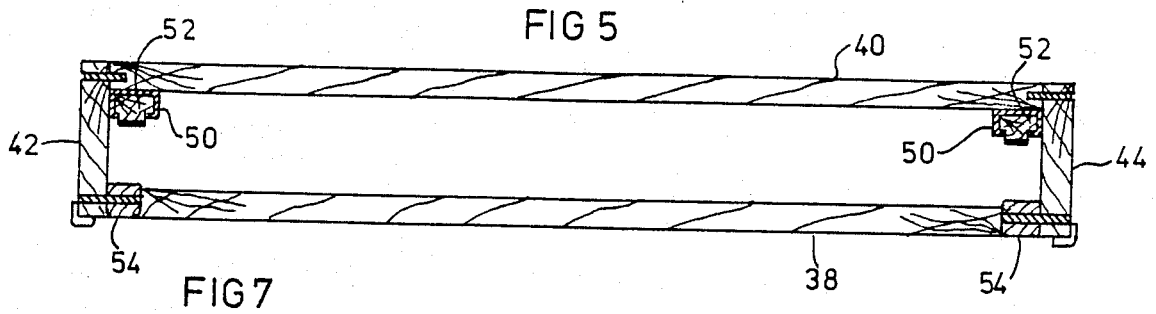
FIG. 5 is a section taken along the line AA in FIG. 3.

Within the cabinet 18, are a pair of metal channels 50, fastened vertically to the inside of the back wall 40 of the cabinet. The channels 50 have folded over edges to retain slide blocks 52 within the channels, as best shown in FIG. 5. The slide blocks 52 are free to move vertically within the channels 50. The front wall of the cabinet 38 is slightly forshortened to provide clearance for a pair of rollers 54, free to rotate on rods fastened into the sides 42 and 44, respectively. As shown in FIG. 6, the inboard table section 12 may rest upon the rollers 54 as well as the gussets 30 and 32 in the horizontal position. The inboard table section 12 is fastened to a pair of hinges 56, in turn fastened to the slide blocks 52. In folding the inboard table section 12 into the cabinet, the table section 12 rolls over and about the rollers 54 and the guide blocks 52 descend along the channels 50 toward the bottom of the cabinet.

Figure 7:
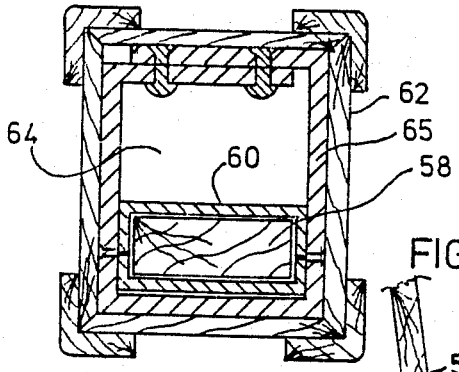
FIG. 7 is a section taken along the line CC in FIG. 4.
Figure 4:
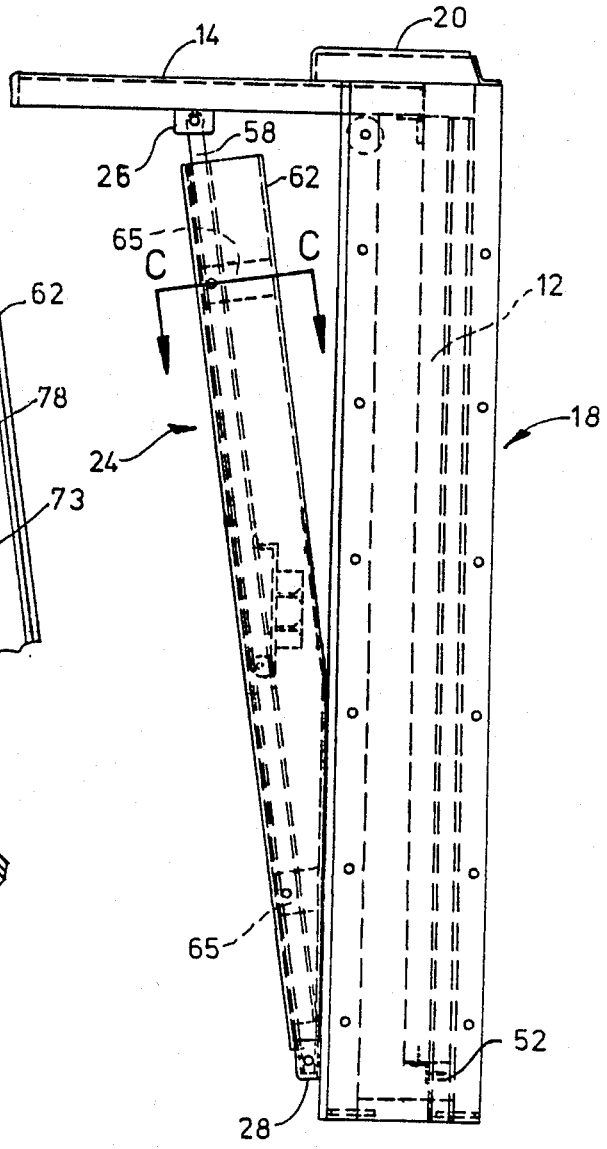
FIG. 4 is a side view of the table in the folded position.

The support means 24 comprises a pair of telescoping members 58 and 60. The wooden member 58 slides within the hollow aluminum rectangular member 60 as best shown in FIG. 7 as the table is folded from the extended position shown in FIG. 1 to the fully retracted position shown in FIG. 4. As shown in FIG. 4, the inboard table section 12 lies vertically within the cabinet 18 and the slide blocks 52 are at the bottom of the cabinet. The aluminum member 60 is substantially enclosed within a hollow cover 62 with the wooden member 58 extending from the upper end of the cover 62 to the pin attachment 26 on the bottom surface of the outboard section 14 of the table.

Figure 9:
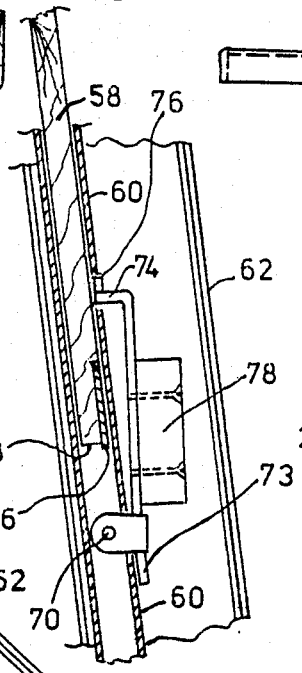
FIG. 8 and FIG. 9 are cut-away cross sections showing the latch mechanism circled in FIG. 4 in open and closed positions respectively.
Figure 8:
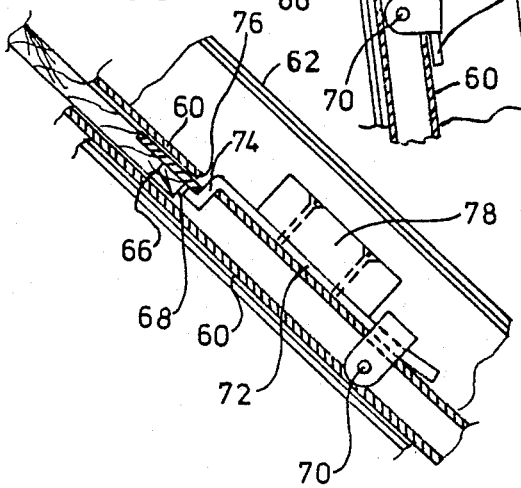

Within the cover 62 is ample hollow space 64 for a latch mechanism as best shown in FIGS. 8 and 9. The end of the wooden member 58 within the hollow member 60 includes a metal tip 66 extending slightly beyond the end 68 of the wooden member 58. Affixed to the hollow member 60 for rotation at 70 is a latch 72 having a dog leg end 74 which extends into or through a hole 76 in the upper side of the hollow member 60. As best shown in FIG. 8, the dog leg 74 is adapted to extend throught the hole 76 and engage the tip 66 of the wooden member 58. Attached to the latch 72 is a counter weight 78 which causes the latch 72 and dog leg 74 to drop downward against the hollow member 60 and through the hole 76 respectively when the support means is in its lowermost position at the open position of the table. When the table is raised, as described below, to fold the table into the cabinet to the closed position, the support means 24 is tilted more and more toward the vertical with the wooden member 58 first being withdrawn from the latch leg 74. Then the wooden member 58 is extended into the hollow member 60 after the counter weight 78 has caused the latch 72 to draw the dog leg 74 substantially out of the hole 76, thereby permitting the wooden member 58 to slide past the latch as shown best in FIG. 9. Thus, the latch 72 operates automatically to latch the support member 24 with the table in the fully open position and releases automatically when the table is retracted into the cabinet.

The dog leg 74 end fits under the extended tip 66 to prevent the latch 72 from inadvertent release due to vibration or jarring of the table. A tall 73 extending below the pivot 70 prevents the dog leg 74 from movement out of the hole 76 beyond that necessary for clearance of the wooden member 58. Thus, the latch 72 has only one moveable part and requires no springs, cams or cables.

As best shown in FIG. 7, the outside of the cover 62 is fastened to a pair of aluminum rectangles 65, in turn attached to the hollow aluminum member 60. Clearance for the latch pivot 70 within the cover is thereby provided. With the exception of the pivots at 26 and 28 the metal portions of the folded table are substantially hidden from view.

Figure 11B:
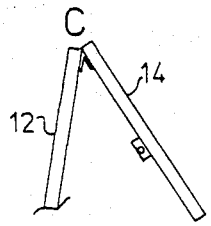
FIG. 10 and FIGS. 11A–11C illustrate the opening and closing sequence in the side views of the table.
Figure 11C:
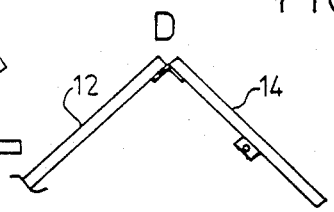
Figure 10:
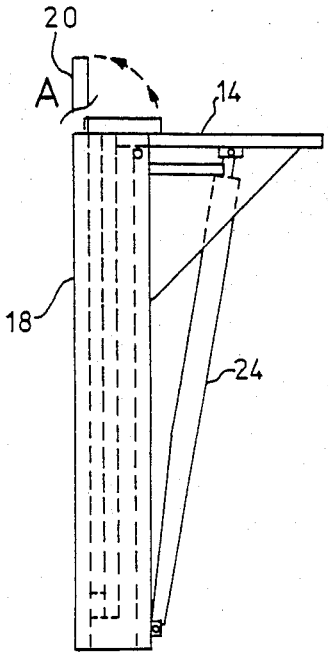
Figure 11A:
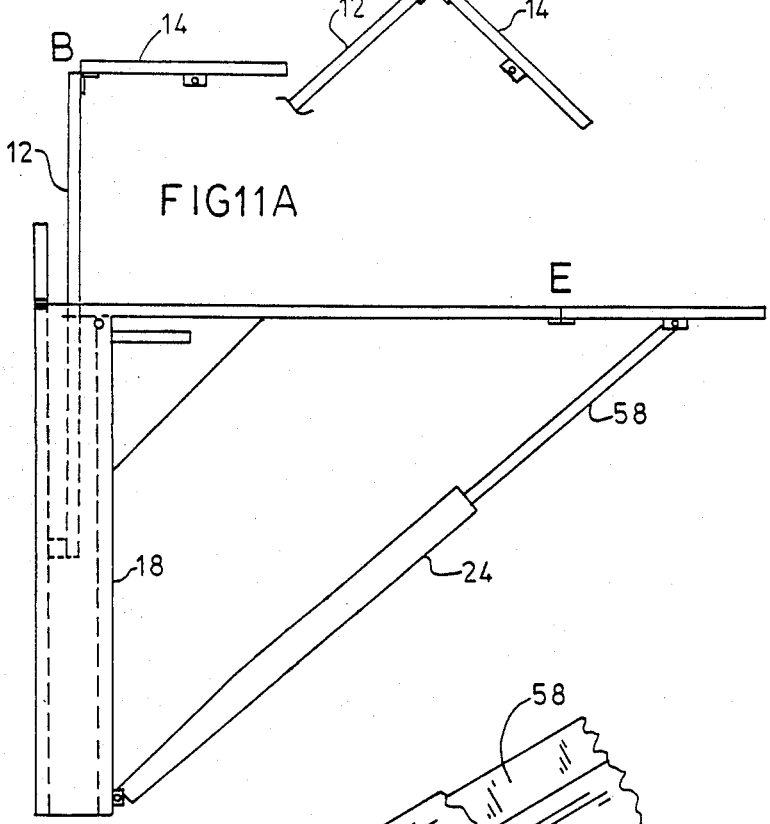

FIGS. 10 and 11 illustrate the folding and unfolding of the table in more detail. Whether to fold or unfold the table, initially the cover 20 is opened as shown in FIG. 10 at A. In unfolding the table, the table is raised vertically as shown at B in FIG. 11 to draw out the inboard section 12 from the cabinet 18. As the inboard table section 12 is almost entirely out of the cabinet 18, it is first slightly rotated as shown at C and then more fully rotated as shown at D as it rolls about the roller 54 until the table is flat as shown at position E. By the time the horizontal position E is reached, the latch 72 has automatically dropped into position for engagement with the tip 66 of the wooden member 58. To refold and retract the table back to the short position of FIG. 10, the sequence is merely reversed. The cover 20 is in the downward position after folding or unfolding whether the table is in the short position as shown in FIGS. 4 and 10 or in the extended position as shown in FIG. 1.

Figure 12:
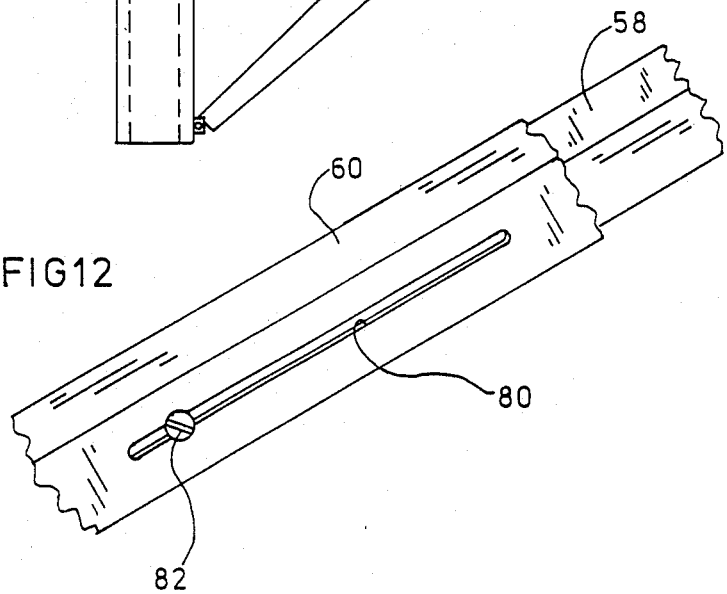
FIG. 12 is a cut-away detail of the support members within the support cover.

The engagement of the hollow member 60 with the telescoping wooden member 58 includes a slot 80 formed in the hollow member 60 on the opposite side from the latch opening 76 and a screw 82 fastened into the wooden member 58 and slideable in the slot 80, as best shown in FIG. 12. Thus, the wooden member 58 is prevented from being fully removed from the member 60 when the table is raised.

I claim:

1. A folding table comprising a hollow vertical enclosure having a top, an aperture in the top of the enclosure, an inboard table section and an outboard table section, a hinge joining the sections together, vertical guide means within the enclosure, said vertical guide means including means rotatably and slideably attaching the inboard section to the enclosure, roller means attached to the enclosure and spaced from said vertical guide means, said roller means engaging the inboard section during movement of the inboard section into and out of the enclosure through the aperture, support means extending from the outboard section to the enclosure, said support means pivotally attached to both the outboard section and the enclosure, and said outboard section forming a horizontal side table with the support means supporting the side table upon insertion of said inboard section vertically into the enclosure.

2. The folding table of claim 1, including a cover attached to the enclosure and movable over said aperture, said cover adapted to close with the table sections extended or retracted.

3. The folding table of claim 1, including a latch on said support means between the outboard section and the enclosure, said latch balanced to latch automatically with the table fully extended and to unlatch automatically upon vertical folding movement of the extended table.

4. The folding table of claim 3, including means on the latch to prevent inadvertent disengagement of the latch.

5. The folding table of claim 1, wherein said support means comprise a pair of telescoping members and a latch on one of the members adapted to automatically engage the other member upon full extension of the table and to automatically disengage the other member upon vertical folding movement of the extended table.

6. The folding table of claim 5, including balancing means on the latch to enable the force of gravity to cause the latch to engage or disengage.

7. The folding table of claim 5, including means on the latch to prevent inadvertent disengagement of the latch.

8. The folding table of claim 5, including a support cover extending fully about and beyond the latch.

9. The folding table of claim 1 wherein the inboard table section is longer than the outboard table section.

10. A folding table comprising a hollow vertical enclosure having a top, an aperture in the top of the enclosure, an inboard table section and an outboard table section, at least one hinge joining the sections together, vertical guide means within the enclosure, said vertical guide means including means movably attaching the inboard section to the enclosure, separate guide means attached to the enclosure and spaced from said vertical guide means, said separate guide means engaging the inboard section during movement of the inboard section into and out of the enclosure through the aperture, support means extending from the outboard section and pivotally attached to the enclosure adjacent the lower extremity of the enclosure, and said outboard section forming a horizontal side table with the support means supporting the side table upon insertion of said inboard section vertically into the enclosure.

11. The folding table of claim 10 wherein said support means extends and contracts with extension and retraction of the table respectively.

12. The folding table of claim 10 including a cover attached to the enclosure and movable over said aperture, said cover adapted to close with the table sections extended or retracted.

13. The folding table of claim 10 including a latch on said support means between the outboard section and the enclosure, said latch balanced to latch automatically with the table fully extended and to unlatch automatically upon vertical folding movement of the extended table.

14. The folding table of claim 13 including means on the latch to prevent inadvertent disengagement of the latch.

15. The folding table of claim 13 including a balancing weight on the latch.

16. The folding table of claim 10 wherein the inboard table section is longer than the outboard table section.

* * * * *